United States Patent [19]

Bozung

[11] Patent Number: 4,481,855

[45] Date of Patent: Nov. 13, 1984

[54] ZITHER-LIKE INSTRUMENTS

[76] Inventor: Richard E. Bozung, Rte. 1 Box 286, Mt. Pleasant, S.C. 29464

[21] Appl. No.: 356,392

[22] Filed: Mar. 9, 1982

[51] Int. Cl.[3] ..... G10D 1/12; G10D 3/02; G10G 5/00

[52] U.S. Cl. ..... 84/173; 84/285; 84/327

[58] Field of Search ..... 84/173, 284–291, 84/294, 327

[56] References Cited

U.S. PATENT DOCUMENTS

| | | | |
|---|---|---|---|
| 222,139 | 12/1879 | Kunkel . | |
| 224,535 | 2/1880 | Holtz . | |
| 466,878 | 1/1892 | Buckner | 84/285 |
| 551,254 | 10/1895 | Brand . | |
| 566,388 | 8/1896 | Eschemann . | |
| 621,900 | 3/1899 | Cook . | |
| 659,330 | 10/1900 | Tapley . | |
| 786,941 | 4/1905 | Audet . | |
| 1,116,287 | 11/1914 | Janson . | |
| 1,401,158 | 12/1921 | Kent | 84/284 |
| 1,799,172 | 4/1931 | Large . | |
| 1,945,162 | 1/1934 | Rasmussen | 84/327 |
| 2,096,300 | 10/1937 | Hamilton et al. . | |
| 2,145,718 | 1/1939 | Finney . | |
| 2,473,442 | 6/1949 | Page | 84/287 |
| 3,237,503 | 3/1966 | Peterson, Jr. et al. . | |
| 3,515,026 | 6/1970 | Rohrbough . | |
| 3,699,837 | 10/1972 | Annessa | 84/291 |
| 3,780,612 | 12/1973 | Robinson | 84/173 |
| 3,910,152 | 10/1975 | Kusakawa . | |
| 4,020,730 | 5/1977 | Hill | 84/173 |

FOREIGN PATENT DOCUMENTS

| | | | |
|---|---|---|---|
| 1094119 | 5/1955 | France | 84/173 |
| 999 | of 1887 | United Kingdom | 84/285 |

OTHER PUBLICATIONS

"News Leader", Richwood, West Virginia, Sec. 2, pp. 4–8–15–73.

*Primary Examiner*—Lawrence R. Franklin
*Attorney, Agent, or Firm*—Parkhurst & Oliff

[57] ABSTRACT

An improved zither-like musical instrument, having a high sound box volume to mass ratio, thin sound board, relatively thin tuning pin blocks comprising the ends of the instrument, and a contact earboard for close contact listening while the instrument is being played normally. The instrument produces a mellow, guitar-like sound.

9 Claims, 4 Drawing Figures

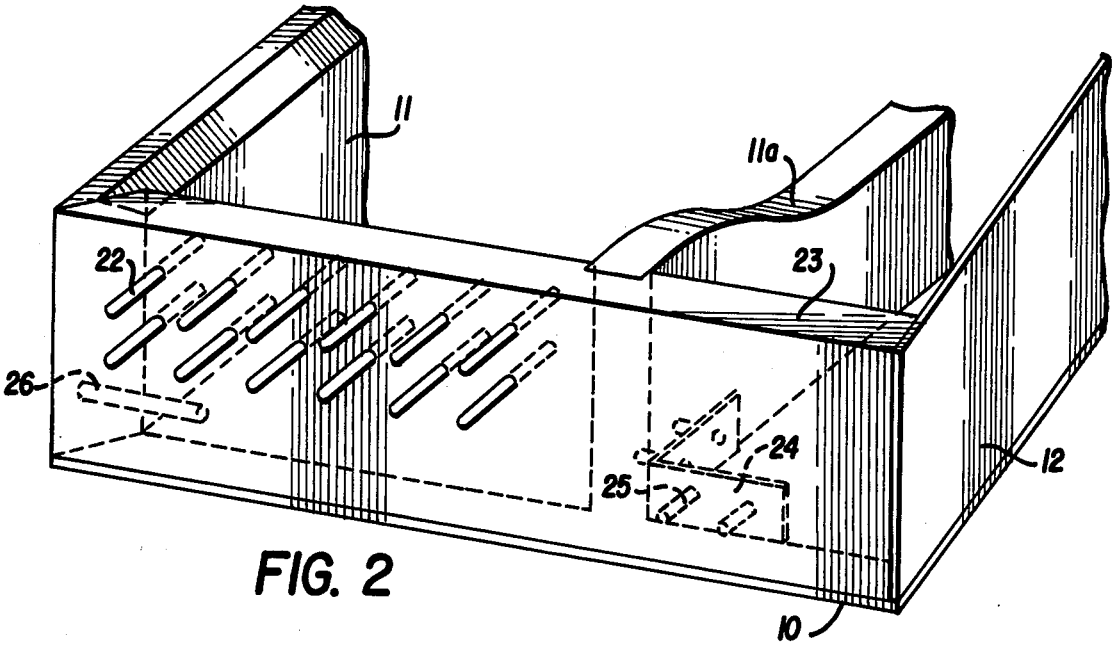
FIG. 2
FIG. 4
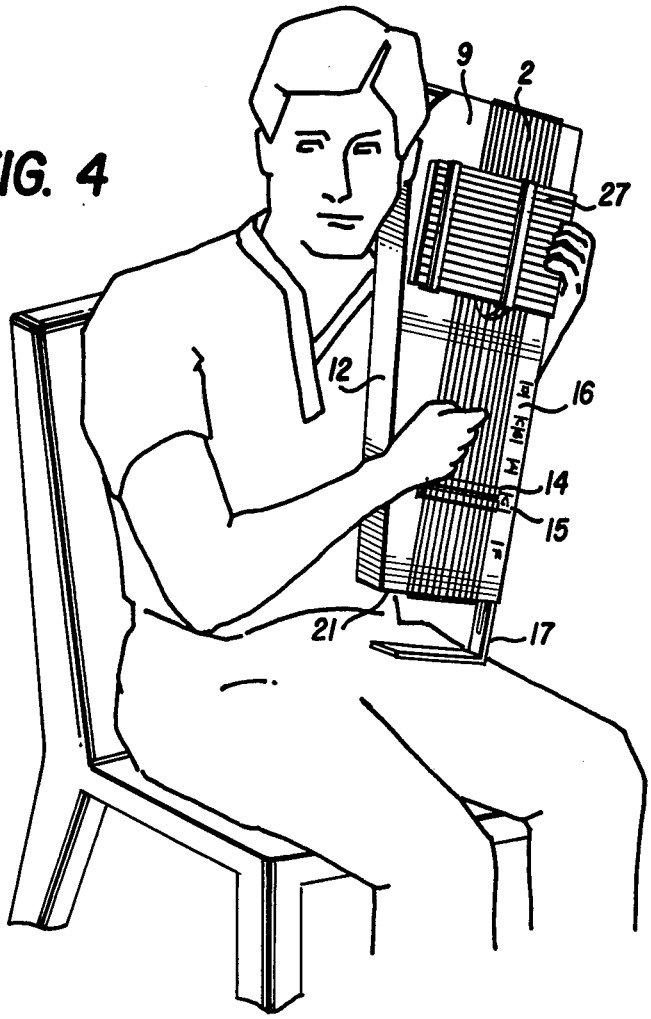

ZITHER-LIKE INSTRUMENTS

BACKGROUND

The present invention relates to improvements in zither-like instruments and new systems for playing and listening to such instruments. More particularly, the improved instruments produce a mellow guitar-like sound, and in one embodiment include a contact earpiece for direct contact listening to the instrument.

There have been several prior attempts to produce zithers which produce a more mellow, guitar-like sound. To do this the following criteria typically must be satisfied: (1) thin sound board; (2) bridge out over the sound board; (3) deep body; (4) elongated body; and (5) large sound box volume. The instrument must also be structurally sound and light in weight. No zither previously known has accomplished all of these things.

Various prior attempts to create such instruments are illustrated in Page U.S. Pat. No. 2,473,422; Rohrbough U.S. Pat. No. 3,515,026; Large U.S. Pat. No. 1,799,172; Peterson U.S. Pat. No. 3,237,503; as well as by the Autoharp instrument.

Rohrbough, utilizing a steel frame, provides a thin sound board, not an attempt to increase sound box depth, and is limited by choosing to provide four octaves of string range requiring very short treble strings and therefore the traditional triangular autoharp shape. Rohrbough also incorporates a relatively massive head block and a smaller but also relatively massive foot block. The result is an instrument with a low sound box volume to mass ratio similar to all the other prior instruments cited herein. A comparison of these various designs with a typical guitar, demonstrates that only the present invention can produce a lightweight instrument with large sound box volume and depth, and accommodate one bridge placed out over the unsupported portion of a thin sound board. Although Rohrbough is able to provide a thin sound board, the bridge cannot be placed out over the sound board, simply because a thin sound board could not support the downward stress imposed by 30 to 40 tensioned strings.

Large incorporates a bridge which optionally can be inserted over the non-supported portion of the sound board. Even though significantly fewer strings are provided in this and the Peterson design, a thick sound board is required because in such a shallow body design, the sides and backboard alone will not maintain the top of the instrument in a planar surface. Only the addition of a thick sound board would prevent the bending and twisting of the entire instrument. Had the depth of these instruments been significantly increased, the sides would have resisted this bending action and a thin sound board could have been provided. However, because both instruments utilize a conventional design involving massive tuning pin and hitch pin blocks, with the pins facing upward, any significant increase in the depth of the instrument results in a substantially increased block depth and in a very heavy instrument not suitable for play in a guitar-like mode. The Page design is similar to conventional autoharps except that the sound box depth, and therefore volume, are greatly increased. But the weight of the instrument is greatly increased, for the same reasons cited previously, and the sound box volume to weight ratio stays low.

BRIEF DESCRIPTION

Accordingly, it is an object of the present invention to overcome the aforementioned deficiencies of the prior art.

It is an object of the present invention to provide a lightweight zither-like instrument with a large sound box volume, substantial sound box depth, with a string bridge over the unsupported portion of a thin sound board.

It is another object to provide a zither-like instrument having a thin contact earboard for direct contact listening by the player of the instrument.

It is another object of this invention to provide a zither-like instrument having a side or back which functions as an earboard, the upper end of which may be held directly against the human ear with the longitudinal axis of the instrument being generally upright while the instrument is being played normally, i.e., one hand depresses chord bars and another strums or picks the strings while the player is in an uncontorted, comfortable upright position.

The present invention includes structural improvements to zithers to facilitate (1) a lightweight instrument with a high sound box volume to mass ratio, (2) production of a mellow balanced guitar-like sound, (3) an instrument which can be hugged comfortably while being played, and (4) includes one side called an earboard against which the head and ear can be rested comfortably while the instrument is being played, producing the sensation of literally being inside the instrument or like listening to amplified music. These features are incorporated in a zither-like instrument with equal length strings, a movable bridge and strings all tuned to notes in a single key. In addition to the instrument being played in conventional positions, such as upon the lap, or hung from the shoulders as a guitar and visually chorded, this new instrument can be embraced while supported upon the lap, and randomly chorded and picked producing harmonious music. Key indicia on the sound board may designate positions to which the bridge can be moved to produce music in any one of a plurality of keys.

DESCRIPTION OF THE DRAWINGS

FIG. 2 is another perspective view showing the thin earboard along one side;

FIG. 4 is a zither fitted with the conventional multi-dampener bar chording mechanism, embraced with head and ear resting against the ear board, and supported in the lap of the player.

One of the most frequent criticisms of chord zithers, has been their tinny sound. Because of the many strings used, and the practice of placing the tuning pins (and sometimes the hitch pins) face up, large massive pin blocks have been required. These instruments have been shallow bodied, since any significant increase in depth only significantly increases the mass of the pin blocks and raises the overall weight of the instrument beyond acceptable limits. With a shallow bodied instrument, the sides placed under the stress of a multitude of strings are subject to bending, which they cannot withstand unless made of steel, or unless the instrument incorporates thick sound and backboards. This also necessitates that the instruments be relatively short. The net result is an instrument of shallow depth, small sound box volume and a thick non-resonant sound board. Placing the bridge out over the sound board is impractical if there are more than two dozen strings. And, that is fruitless anyway because the sound board must be thick, since it serves as a structural member to retard bending about the axis perpendicular to the strings, and thus it does not respond tonally to the change.

Figure 1:
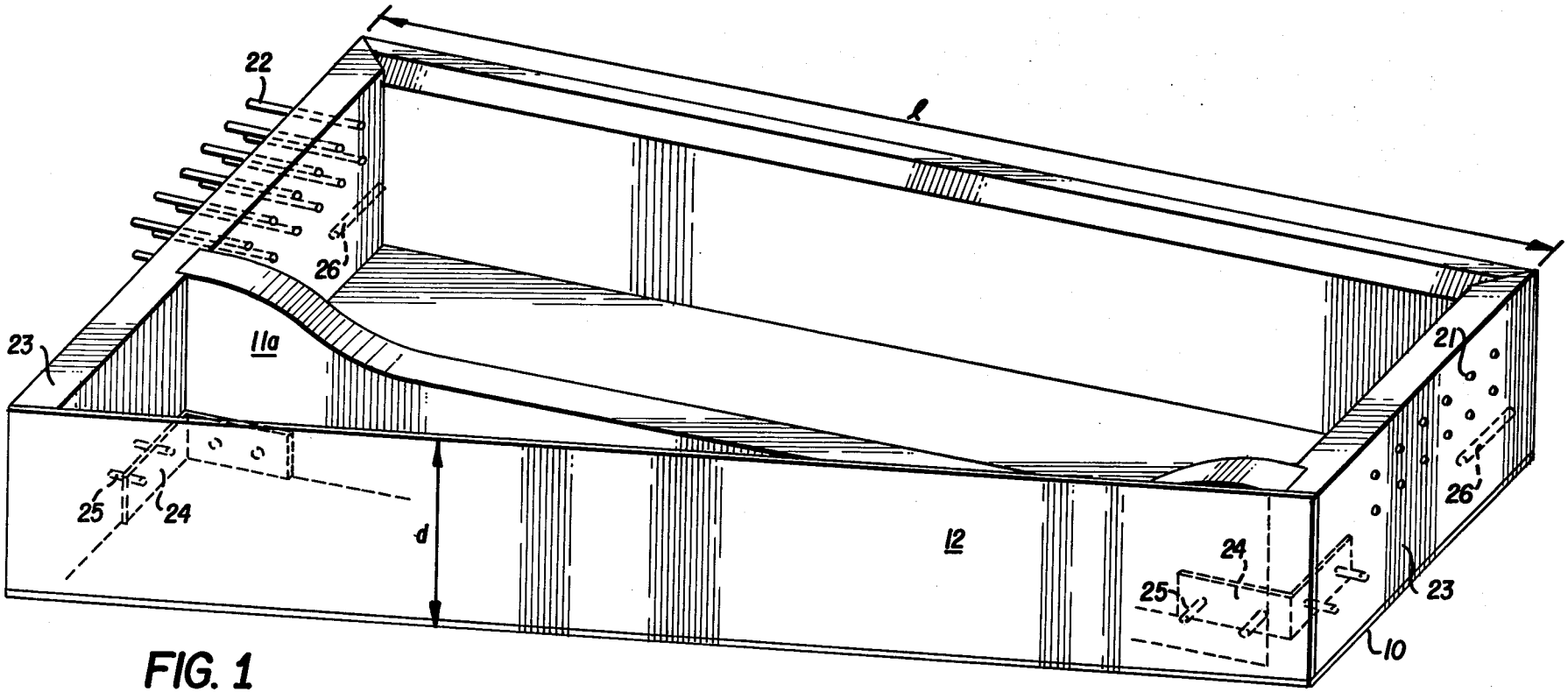
FIG. 1 is a perspective view of the unique zither construction of the present invention.
Figure 3:
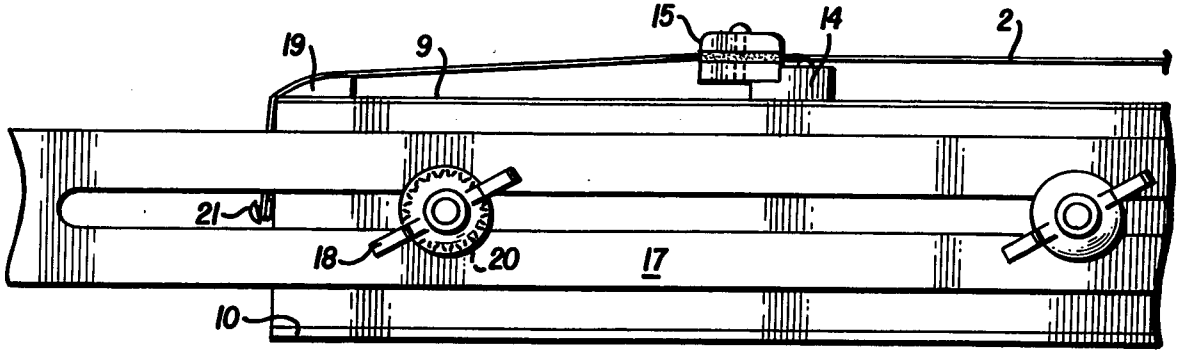
FIG. 3 is a side view of the instrument showing the support mechanism.

FIG. 1 is a perspective view of the unique and totally different zither structure of the present invention which is: (1) extremely resistant to bending in any direction; (2) does not require a thick sound board for structural purposes and therefore facilitates the use of a very thin, highly resonant sound board 9 as shown in FIG. 3; and a moveable bridge 14 and mute 15 may be placed over the sound board to increase resonance even where a couple dozen or fewer strings are utilized; (3) is stronger and can be made much longer than conventional zithers; the deeper the structure becomes, the more greatly it magnifies bass resonance, a characteristic uncommon to conventional zithers; and (4) does not require massive pin blocks at each end of the instrument. It is a lightweight structure of large sound box volume and therefore much greater sound volume. The sound box volume to mass ratio for this new instrument is at least five times that for previously cited zither designs and approaches or equals the ratio for typical guitars. It produces a very mellow balanced, strong, guitar-like sound, requiring less tension in the strings than heretofore practicable with zithers.

As shown in FIG. 2, the essence of the design involves tuning the pin blocks 23 which hold hitch pins 21 and tuning pins 22, on end, reducing their thickness to approximately ¾ inch, for example, and securing them to deep side members 11 of approximately the same thickness at the bottom. The deep side members are glued to a thick backboard 10. The bottom edge of the pin block is also glued to the backboard. Dowels or pins 26 or brackets 24 with screws 25 are employed at the bottoms to prevent the pin blocks from rotating away from the instrument while under the tension of the strings. Notches are provided in the side members and pin blocks to restrain the pin block tops from rotating inward under the tension of the strings. Although the instrument may be of a simple rectangular or trapezoidal shape, with pin blocks at the ends and two structural sides, one of the structural supports, for example 11*a*, may be cut down so as not to touch the sound board 9 and increase the overall sound box volume and be completely internalized within the instrument, as shown in FIGS. 1 and 2, thereby allowing addition of a thin, highly resonant side hereinafter called the earboard 12, which is attached to the thin, highly resonant sound board.

When the ear is rested against this thin resonant ear board, one experiences the sensation of almost going inside of, or becoming one with, the instrument. Because of the instrument's elongated shape, and/or adjustable support mechanism 17, see FIGS. 3 and 4, it can comfortably be supported in the lap, the head and ear rested against the earboard and played very comfortably. The support mechanism 17 portrayed in FIGS. 3 and 4 is simply any device which is movable, yet a part of the instrument, and which can be locked in place at different positions via support tightening nuts 18 and washers 20. The bottom bridge of the instrument 19, is also shown in this view. The support mechanism can be moved to a variety of positions, allowing persons of different size to fit the instrument to their own body size, allowing them to play the instrument with ear against earboard while not having to support the instrument on their back but instead, allowing for the instrument to be supported on the lap, if played for example, in a sitting position.

Playing a musical instrument, particularly for a beginner, usually requires a high level of concentration. With conventional zithers which are chromatically tuned, meaning strings are tuned to 12 different notes, one must be somewhat selective about what chord bars and strings are being played. That is, random picking and chording does not create particularly pleasing music because of the key modulations involved. However, the present design not only provides a lightweight instrument of beautiful tonal quality, which can be embraced while being played with head and ear resting comfortably against one side while in an upright sitting position, but it can be played very simply, strings and chord bars depressed and plucked at random, producing beautiful, harmonious music, simply by designing the tuning of the strings to be in one key.

As an example in FIG. 4 is shown a zither with multiple chord bar mechanism 27, the strings 2 of which are either tuned diatonically (that is all strings sounding in one key, which would be seven different notes), or with one or more bars, which could be depressed and locked in place dampening all strings which do not fit in the key being played. To play in other keys, the new zither has a movable bridge 14 and mute 15, with corresponding indicia 16 on the sound board to identify the key for various positions of the bridge as in FIG. 4. The inventive design approach gives a full two octave range while minimizing the number of strings on the instrument.

What is claimed is:

1. A zither-like musical instrument for producing a mellow, guitar-like sound comprising:

a sound box body comprising first, second, third and fourth side members and a backboard;

a sound board fitted over and secured to said first, second, third and fourth side members of said sound box body;

a plurality of strings extending over said sound board in a longitudinal direction;

said first side member comprising a first pin block further comprising means for securing one end of each string to said first pin block;

said second side member comprising a second pin block further comprising means for securing the other end of each string to said second pin block;

said third side member of said sound box body comprising a thin construction for freely vibrating with said sound board;

said fourth side member of said sound box body comprising a thick construction for providing structural support to said sound box body;

a support member contained within said sound box body, being secured to said first and second side members and said backboard, and being cut away at one edge to allow the sound board to vibrate freely;

a movable bridge; and indicia on said sound board designating different positions to which said movable bridge can be moved to change the musical key in which said strings are tuned.

2. The zither-like instrument as claimed in claim 1, wherein said plurality of strings comprise at least a two octave range.

3. The zither-like instrument as claimed in claim 1, wherein said movable bridge is disposed over an unsupported portion of said sound board.

4. The zither-like instrument according to claim 1, wherein means for securing one end of said plurality of strings comprises tuning pins mounted in said first pin block with said tuning pins having an axis substantially parallel to a longitudinal axis of said sound box body.

5. The zither-like instrument according to claim 4, wherein means for securing another end of said plurality of strings comprises hitch pins mounted in said second pin block with said hitch pins having an axis substantially parallel to a longitudinal axis of said sound box body.

6. The zither-like musical instrument according to claim 1, wherein said plurality of strings comprise equal lengths.

7. The zither-like instrument as claimed in claim 1, further comprising an adjustable extension attachable to said sound box body with means for supporting said instrument in a lap of a person playing said instrument.

8. The zither-like musical instrument according to claim 7, wherein said plurality of strings comprise equal lengths.

9. The zither-like instrument as claimed in claim 1, wherein said support member substantially diverges from said third side member of said sound box body.

* * * * *